US011396852B2

(12) United States Patent
Nair et al.

(10) Patent No.: US 11,396,852 B2
(45) Date of Patent: Jul. 26, 2022

(54) DETECTION OF FUEL INJECTOR FAILURE SYSTEMS AND METHODS

(71) Applicant: Transportation IP Holdings, LLC, Norwalk, CT (US)

(72) Inventors: Nikhil Nair, Bengaluru (IN); Bharath Chandrashekar, Bengaluru (IN); James Robert Mischler, Erie, PA (US); Sri Harsha Perni, Bengaluru (IN)

(73) Assignee: Transportation IP Holdings, LLC, Norwalk, CT (US)

( * ) Notice: Subject to any disclaimer, the term of this patent is extended or adjusted under 35 U.S.C. 154(b) by 0 days.

(21) Appl. No.: 17/465,347

(22) Filed: Sep. 2, 2021

(65) Prior Publication Data

US 2022/0065185 A1 Mar. 3, 2022

Related U.S. Application Data

(60) Provisional application No. 63/074,324, filed on Sep. 3, 2020.

(51) Int. Cl.
*F02D 41/22* (2006.01)

(52) U.S. Cl.
CPC ..... *F02D 41/22* (2013.01); *F02D 41/221* (2013.01); *F02D 2041/224* (2013.01); *F02D 2041/228* (2013.01); *F02D 2200/0625* (2013.01)

(58) Field of Classification Search
CPC ..... F02D 41/22; F02D 41/221; F02D 2041/224–228; G01F 9/00
USPC ..... 701/114; 73/114.38, 114.45, 114.48, 73/114.52, 114.77
See application file for complete search history.

(56) References Cited

U.S. PATENT DOCUMENTS

| | | | | |
|---|---|---|---|---|
| 5,058,547 | A | 10/1991 | Morikawa | |
| 5,469,825 | A | 11/1995 | Golab | |
| 6,192,854 | B1 * | 2/2001 | Polach | F02M 63/0205 123/198 DB |
| 2004/0088130 | A1 | 5/2004 | Weiland | |
| 2005/0051139 | A1 | 3/2005 | Slater et al. | |
| 2010/0024777 | A1 | 2/2010 | Hoffmann et al. | |
| 2014/0182550 | A1 * | 7/2014 | Gerstner | F02M 63/0054 123/445 |

(Continued)

FOREIGN PATENT DOCUMENTS

DE 102005034449 B4 7/2017

*Primary Examiner* — Robert A Werner
(74) *Attorney, Agent, or Firm* — The Small Patent Law Group LLC; Christopher R. Carroll

(57) ABSTRACT

A system includes one or more processors that are configured to obtain a measured fuel consumption rate for an internal combustion engine while the engine is operating at a predetermined operating condition to perform a mission. The one or more processors are also configured to compare the measured fuel consumption rate with an expected fuel consumption rate for the predetermined operating condition. Further, the one or more processors are configured to determine whether an injector flow limiter is in a latched condition based on the measured fuel consumption rate compared with the expected fuel consumption rate. Also, the one or more processors are configured to perform a responsive action responsive to determining that the injector flow limiter is in the latched condition.

20 Claims, 2 Drawing Sheets

(56) References Cited

U.S. PATENT DOCUMENTS

2014/0360255 A1* 12/2014 Javelot ..... F01D 21/20
73/114.38
2015/0377199 A1* 12/2015 Radl ..... F02D 41/06
123/456

* cited by examiner

DETECTION OF FUEL INJECTOR FAILURE SYSTEMS AND METHODS

RELATED APPLICATIONS

This application claims priority to U.S. Patent Application Ser. No. 63/074,324, entitled "Detection of Fuel Injector Failure Systems and Methods," filed Sep. 3, 2020, the entire subject matter of which is incorporated by reference herein.

BACKGROUND

Technical Field

The subject matter described relates to systems and methods for use in detecting fuel injector failures, for example detection of a latched condition of one or more fuel injectors during operation of an engine for an intended use.

Discussion of Art

Internal combustion engines may be utilized in a variety of applications. Internal combustion engines may utilize fuel injectors to control the amount and timing of introduction of fuel into one or more cylinders. During use, a fuel injector may develop a fault, causing a latching of a fuel limiting valve that stops the flow of fuel through the fuel injector to a corresponding cylinder. Conventional methods of electrical diagnosis of engines may detect electric failure such as an open circuit or a short circuit during use of an engine, but not latching of a fuel limiting valve. Also, conventional approaches to detect dead cylinders are utilized at particular conditions when an engine is not being used for an intended purpose, requiring the engine to be taken off-line. Accordingly, conventional approaches result in periods of inoperation of an engine to identify latching of fuel limiting valves, adding time and expense for diagnosis, and resulting in increased wear on engine parts until the latching is identified.

BRIEF DESCRIPTION

In one embodiment, a system includes one or more processors that are configured to obtain a measured fuel consumption rate for an internal combustion engine while the engine is operating at a predetermined operating condition to perform a mission. The one or more processors are also configured to compare the measured fuel consumption rate with an expected fuel consumption rate for the predetermined operating condition. Further, the one or more processors are configured to determine whether an injector flow limiter is in a latched condition based on the measured fuel consumption rate compared with the expected fuel consumption rate. Also, the one or more processors are configured to perform a responsive action responsive to determining that the injector flow limiter is in the latched condition.

In one embodiment, a method includes operating an internal combustion engine at a predetermined operating condition. The method also includes obtaining a measured fuel consumption rate for the engine while the engine is operating at the predetermined operating condition to perform a mission. Further, the method includes comparing the measured fuel consumption rate with an expected fuel consumption rate for the predetermined operating condition. The method also includes determining whether an injector flow limiter is in a latched condition based on the measured fuel consumption rate compared with the expected fuel consumption rate. The method further includes performing a responsive action responsive to determining that the injector flow limiter is in the latched condition.

In one embodiment, a system includes an internal combustion engine, a fuel injector, and one or more processors. The fuel injector is coupled to the engine, and provides fuel to the engine. The fuel injector has an injector flow limiter movable between an open state and a latched state. In the open state, fuel is provided to the internal combustion engine via the fuel injector. In the latched state, fuel is not provided to the internal combustion engine via the fuel injector. The one or more processors are coupled to the internal combustion engine. The one or more processors are configured to obtain a measured fuel consumption rate for the internal combustion engine while the engine is operating at a predetermined operating condition to perform a mission. The one or more processors are also configured to compare the measured fuel consumption rate with an expected fuel consumption rate for the predetermined operating condition, and to determine whether an injector flow limiter is in a latched condition based on the measured fuel consumption rate compared with the expected fuel consumption rate. Further, the one or more processors are configured to perform a responsive action responsive to determining that the injector flow limiter is in the latched condition.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
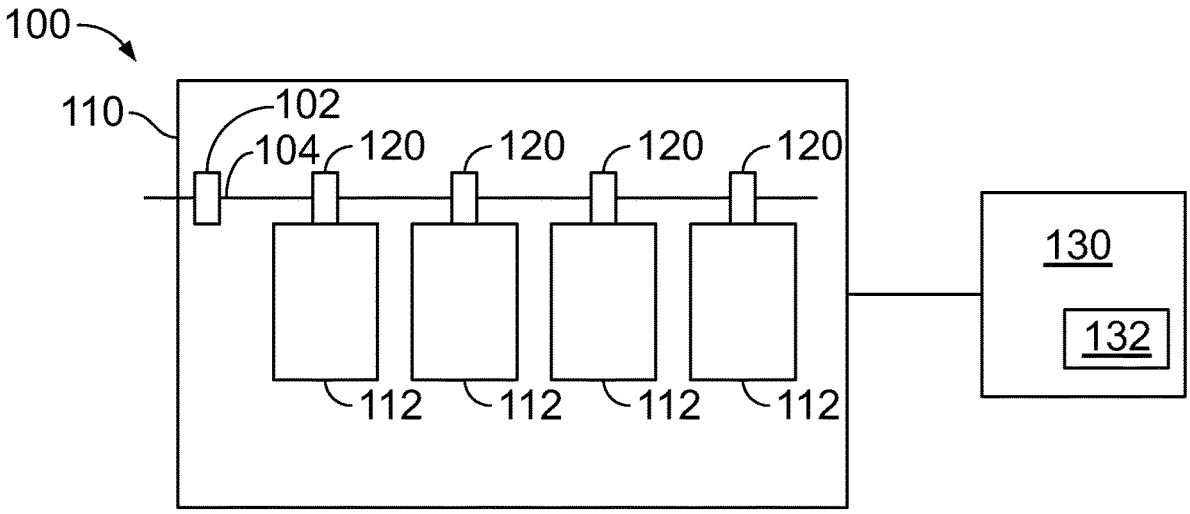
FIG. 1 illustrates a block schematic diagram of a system.

Embodiments of the subject matter described herein relate to systems and methods for determining or identifying a fault of an internal combustion engine. For example, various embodiments provide for improved determination or identification of a latched condition of one or more fuel injectors, for example while the engine is being utilized to help propel a vehicle along a route.

Generally, whenever a cylinder fails, total fuel flow to the remaining operational cylinders will be increased to maintain the desired engine speed. Various embodiments monitor changes in fuel flow and determine latching of injectors based on comparisons of a measured fuel flow with expected fuel flow for similar operating conditions.

For example, various embodiments calculate an average per cylinder fuel value at one or more engine operating conditions at regular intervals (e.g., when there are no transients for some persistence time) and store the information. The stored information is then used to learn the per cylinder fuel consumption at the corresponding engine operating condition(s). Various embodiments compensate for injector wear and/or part-to-part variations by using a band or range of fuel consumption rates based on known wear patterns and/or known variations in individual injectors (e.g., known tolerances). Various embodiments use a neural network for learning engine consumption behavior and setting up baseline or expected fuel consumption levels. The neural network in various embodiments is trained to distinguish between fuel consumption changes due to slow changes (e.g., injector wear) and fast changes (e.g., transient loads).

The fuel consumption value may then be monitored and compared with the baseline or expected values. If the measured or monitored value goes beyond a predetermined limit of the range or band (or other expected value) a latch condition may be potentially identified. Other potential causes may be investigated and, if no such other potential causes exist, a latched condition may be determined. For example, an engine control unit (ECU) may separately monitor electrical failures. As another example, mechanical failures (e.g., crankshaft) may be identified based on conditions such as high water and/or oil temperature.

Various embodiments provide improved engine reliability by providing for early injector failure detection. Various embodiments also provide improved fuel system protection by helping prevent combustion gases entering fuel lines via a nozzle due to reduced back pressure or a lack of back pressure.

While various examples herein may be discussed in connection with rail vehicles, it may be noted that not all embodiments described herein are limited to rail vehicle systems. For instance, one or more embodiments may be used in connection with hybrid-electric vehicles. As examples, one or more embodiments of the detection systems and methods described herein can be used in connection with other types of vehicles, such as automobiles, trucks, buses, mining vehicles, marine vessels, aircraft, agricultural vehicles, or the like.

FIG. 1 illustrates a schematic diagram of a system 100. The system includes an internal combustion engine 110, a fuel injector 120, and a processing unit 130. The system in various embodiments is used to provide motive power for a rail vehicle. In other embodiments, the system may be used in connection with other vehicles, such as automobiles, trucks, or ships, by way of example.

The internal combustion engine in various embodiments includes multiple cylinders 112 having at least one fuel injector per cylinder. In the illustrated embodiment, the internal combustion engine includes four cylinders having one fuel injector each. Other arrangements may be utilized in other embodiments. In various embodiments, the internal combustion engine is configured to utilize diesel fuel for use with a rail vehicle. However, it should be noted that other types of fuel and/or other types of vehicles may be utilized in alternate embodiments. For example, the internal combustion engine may be configured to use automotive fuel or natural gas additionally or alternatively to diesel fuel.

Figure 2:
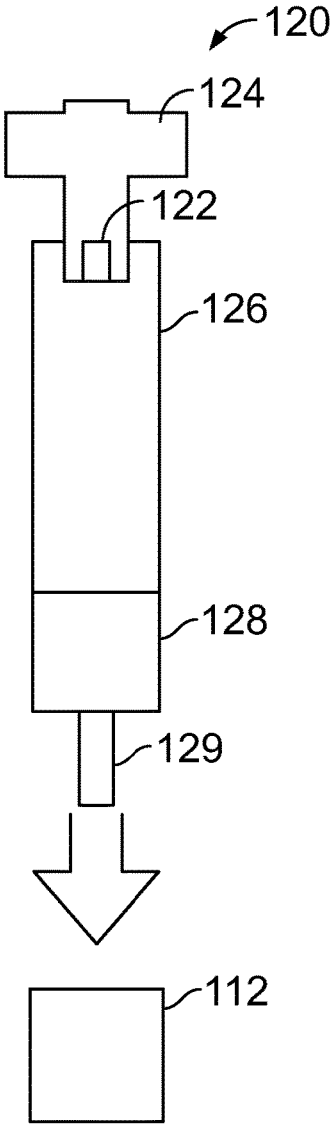
FIG. 2 provides a schematic sectional view of a fuel injector for the system of FIG. 1.

Each fuel injector is coupled to the internal combustion engine, and configured to provide fuel to the internal combustion engine. In the depicted embodiment, each fuel injector provides fuel to a particular cylinder to which that fuel injector is coupled. An example individual fuel injector is depicted in FIG. 2. The fuel injector provides a path via which a controlled amount of fuel is provided to the cylinder. Further, in the depicted example, the fuel injector includes an injector flow limiter 122. In various embodiments, the injector flow limiter includes a valve that stops flow through the fuel injector to the cylinder when one or more aspects of the fuel injector become damaged. For example, in the illustrated example, the fuel injector includes a T-piece 124 used to provide fuel via the injector flow limiter. The fuel injector also includes an injector body 126, a solenoid valve 128, and a nozzle 129. If either the solenoid valve or the nozzle becomes damaged, the injector flow limiter is configured to prevent fuel from flowing from the T-piece to the cylinder via the injector flow limiter. Instead, fuel provided to the T-piece is directed to other cylinders, by-passing the solenoid valve and nozzle of the depicted fuel injector.

In the depicted example, the injector flow limiter is movable between an open state and a latched state. Generally, in the open state, fuel is provided to the internal combustion engine (e.g., cylinder) via the fuel injector. In the latched state, fuel is not provided to the internal combustion engine via the fuel injector. For example, when there are no faults within the fuel injector and the internal combustion engine is operated, the injector flow limiter is in the open state, and fuel is provided to the internal combustion engine via the fuel injector. However, responsive to a failure of one or more aspects of the fuel injector, the injector flow limiter latches (or moves from the open state to the latched state, for example by closing a valve) to prevent flow through the fuel injector to the cylinder associated with the fuel injector. The latching helps reduce or prevent further damage that may result from uncontrolled flow through the fuel injector, but also cuts off fuel to the associated cylinder resulting in reduced engine performance and/or efficiency.

For example, to maintain a given output level of the internal combustion engine (e.g., a desired speed, horsepower, or torque), more fuel may be directed to other cylinders to account for the lost output of any cylinders having fuel injectors in the latched condition, resulting in a higher fuel consumption rate for the entire engine when one or more cylinders become non-operational due to a latched condition. This allows the internal combustion engine to remain functioning within desired output parameters, but increases wear and tear on other cylinders, and/or increases chances of faults of other cylinders, and/or reduces efficiencies. Typical conventional approaches only check whether the fuel injector is in the latched state when the internal combustion engine is off-line. As used herein, off-line may be understood as indicating when the internal combustion engine is not being utilized to perform an intended task. In contrast to such conventional approaches, various embodiments provide for determining or identifying a latched condition when the internal combustion engine is on-line. As used herein, on-line may be understood as indicating when the internal combustion engine is being utilized to perform an intended task (e.g., when the internal combustion engine is being utilized to propel a vehicle to perform a mission or trip).

With continued reference to FIG. 1, the depicted processing unit is coupled to the internal combustion engine. For example, the depicted processing unit in various embodiments is configured to provide control commands to one or more aspects of the internal combustion engine, and to receive information from the internal combustion engine (e.g., from sensors). For example, the depicted system includes a flow sensor 102 coupled to a fuel conduit 104 that provides fuel to the cylinders of the internal combustion engine. The processing unit receives information from the flow sensor corresponding to the amount of fuel provided to the internal combustion engine. The processing unit may also receive information from other sensors disposed on aspects of a vehicle other than the internal combustion engine (e.g., temperature sensors). Additionally or alternatively, the processing unit may be associated with or incorporated into an engine control unit (ECU).

It may also be noted that, additionally or alternatively to the use of one or more flow sensors, fuel consumption rate may also be calculated or estimated by the processing unit and/or other processor. Current engine operating conditions may be estimated, for example, using information received from various sensors, and may be estimated using pre-calibrated cylinder models. In various embodiments, a controller may be employed to estimate the fuel flow rate required to maintain desired operating conditions.

The depicted processing unit is configured to obtain a measured fuel consumption rate for the internal combustion engine while the internal combustion engine is operating at a predetermined operating condition to perform a mission. The measured fuel consumption rate, for example, may be a total fuel flow or consumption rate for the internal combustion engine, or an average fuel flow or consumption rate on a per cylinder basis (based on all cylinders, including operational and non-operational cylinders). The predetermined operating condition in various embodiments corresponds to an engine setting or output level. For example, the predetermined operating condition may be a throttle notch setting (e.g., idle, N1, N2, N3, etc.) Generally, the fuel consumption rate will tend to increase when one or more cylinders are non-operational relative to when all cylinders are operational to maintain a given output or engine setting. As another example, the predetermined operating condition may be an RPM setting or other setting corresponding to engine load and/or output.

The depicted processing unit is also configured to compare the measured fuel consumption rate with an expected fuel consumption rate for the predetermined operating condition. For example, expected fuel consumption rates may be determined for each of plural operating conditions a priori and stored for use by the processing unit (e.g., within memory 132). In various embodiments, for each of plural throttle settings, expected fuel consumption rate information for an engine with all cylinders operated is determined and stored for use by the processing unit. For example, first fuel consumption rate information is stored for a first throttle setting, second fuel consumption rate information is stored for a second throttle setting, and so on. The processing unit may then be configured (e.g., programmed) to determine which throttle setting the internal combustion engine is operating at, select the appropriate expected fuel consumption rate for that particular throttle setting, and compare the measured fuel consumption rate (e.g, as provided by the flow sensor and/or determined using a model) to the expected fuel consumption rate for that particular throttle setting. It may be noted that other engine operational parameters may be used additionally or alternatively to the fuel consumption rate in various embodiments Further, the depicted processing unit is configured to determine whether an injector flow limiter (e.g., one or more of the injector flow limiters) is in a latched condition based on the measured fuel consumption rate compared with the expected fuel consumption rate. The determination in various embodiments is made based on a priori knowledge of engine performance. For example, if the measured fuel rate corresponds to known and/or modeled rates for an engine with all cylinders fully operational and performing within a predetermined tolerance, it is determined that all cylinders are functioning and no fuel limiters are latched. However, if the measured fuel consumption rate corresponds to known and/or modeled rates for an engine with one or more cylinders non-operational, it may be determined that a latched condition exists (or, as discussed herein, that a potentially latched condition exists). In some embodiments, the processing unit determines whether one or more injector flow limiters are latched without identifying which particular injector flow limiter(s) is latched, while in other embodiments the processing unit identifies one or more particular latched injector flow limiters. It should be noted that in various embodiments the processing unit is further configured to distinguish a latched condition from other potential engine and/or fuel injector faults. The processing unit in various embodiments uses a model (e.g., a neurally trained model) to determine whether the injector flow limiter is in the latched condition.

For example, a neural network may be trained using information obtained from the internal combustion engine (and/or comparable engine) operating under known conditions (e.g, various combinations of functioning cylinders at different operating conditions such as different throttle notches). For example, a neural network may be trained using information obtained when an engine is operating at a particular notch with all cylinders functioning, as well as at the particular notch when one or more cylinders are experiencing a latched injector flow limiter. The network may be trained for each of a variety of operating conditions (e.g., at a plurality of different throttle notch settings). Then, the model may be applied during engine use based on the particular operating condition (e.g., particular throttle notch setting) being used at the time.

Accordingly, in various embodiments, the processing unit utilizes known or modeled predetermined fuel consumption rates for a condition (or conditions) in which all cylinders operational as well as known or model fuel consumption rates for when one or more cylinders are non-operational. It may be noted that a neurally trained network model may be updated during ongoing use of the engine.

In various embodiments, a neurally trained network model may be utilized by the processing unit to identify fuel variations due to injector wear, and/or to identify fuel variations due to transient operation (e.g., use of auxiliary loads such as air conditioning). For example, the neural network may be trained using injectors of known age or use to recognize changing behavior of injectors and corresponding changes in fuel consumption rate as injectors wear. Additionally or alternatively, the state of various auxiliary or other transient loads may be identified during training of the neural network to train the model to recognize fuel consumption rates during such transient loads and to distinguish such transient effects from latched injector conditions.

It should be noted that as used herein a "fuel consumption rate" does not necessarily indicate only a single fixed value. For example, in various embodiments, the processing unit is configured to compare the measured fuel consumption rate with a range of rates for the expected fuel consumption rate. To help reduce false positives of latching condition determination or identification, in various embodiments the range of rates is configured to account for at least one of injector wear or injector tolerance variations. The range, for example, may be determined (e.g., via training of a neural network model) based on known or measured performance variations due to wear and/or tolerance variations obtained from engine operation under known conditions (e.g., known states of injector wear and performance at a known throttle notch).

Further, in various embodiments, after identifying a potentially latched condition, the processing unit is configured to determine whether or not the injector flow limiter is in the latched condition by determining whether one or more additional faults exist. For example, the comparison of measured and expected fuel rates may be utilized to identify a preliminarily determined potentially latched condition. Then, if the fuel rate comparison corresponds to a potentially latched condition, the processing unit in various embodiments determines if additional faults are present. Examples of additional faults that may be identified by the processing unit include electrical failures and/or mechanical failures. The additional faults may be identified using information from other systems and/or sensors disposed on-board a vehicle and/or operator input. If it is determined that an additional fault is present, the processing unit may attribute variations in fuel flow rate from expected to the additional fault; however, if no additional faults are identified, the processing unit may classify the potential latched condition as a confirmed latched condition.

As mentioned above, the fuel consumption may be measured with the flow sensor 102 and/or estimated by the processing unit (e.g., using a model). In some embodiments, the flow sensor 102 may be omitted (e.g., to lower cost), and the fuel consumption may be estimated by the processing unit.

In embodiments that utilize a fuel flow sensor to measure flow, some additional steps may be employed. For example, it may be noted that when a cylinder is dead (or not making power), the actual total flow to the engine may or may not increase, depending on the efficiency at that operating point. Further, the increase may be difficult to accurately measure with a flow sensor. It may be further be noted that an ECU estimated fuel consumption value will tend to be more responsive to such an increase and tend to have more resolution than the sensor. Accordingly, in cases where a flow sensor is used, additional steps may be taken.

For example, first, a baseline at certain operating conditions may be learned (e.g., similar to other approaches discussed herein). The actual flow value from the sensor at this time may be used to correct for any flow knowledge gaps (e.g., due to long term injector wear and/or other causes). A neural network may be employed for the learning and baseline setup, including learning the difference between slow changes (e.g., long term injector wear) and fast changes (e.g., operation changes). Bands for typical known variations may be determined.

Next, the fuel consumption may be monitored again at the same operating condition and compared to the baseline or the actual flow consumed. If the change is beyond the band, any other issues related to power assembly failures may be looked for. If none are found, a flag may be set for a possible flow flow limiter latch case.

In the illustrated embodiment, if a latched condition is determined (e.g., based on flow estimated by a processor and/or measured with a sensor), the depicted processing unit is also configured to perform a responsive action responsive to determining that the injector flow limiter is in the latched condition. For example, the processing unit may provide an audible and/or visual alert or message to an operator of the internal combustion engine (e.g., the operator of a vehicle including the internal combustion engine) that one or more cylinders are non-operational. As another example, the processing unit may provide an alert and/or message to a maintenance system or organization, and/or may schedule maintenance for further identification of a particular damaged fuel injector, and/or repair or replacement of fuel injector(s).

As yet another example of a responsive action, the processing unit (e.g., ECU) may perform a recovery operation to unlatch the latched injector. For example, a latched flow limiter may be unlatched if the common rail pressure is drained to a very low value. Accordingly, once a latched injector is detected as discussed herein, in some embodiments the processing unit directs the engine to enter a special operating mode in which it will increase the engine speed and stop the fuel flow in the common rail while still continuing fuel injection. Once the rail pressure is reduced to a very low level, the flow limiter will be unlatched, and the ECU may allow the fuel to flow again to the engine, and re-perform the latch detection test to confirm if the injector has become healthy. Once final results are determined, the determination may be provided to an operator.

In various embodiments, the processing unit is located on-board a vehicle on which the internal combustion engine is disposed, and may be utilized to perform tasks additional to those discussed herein. For example, in some embodiments, the tasks performed or steps executed by the processing unit may be performed by an engine control unit (ECU) with the depicted processing unit representing one or more aspects of the ECU. It may be noted that the depicted processing unit in various embodiments is configured to perform one or more aspects of methods discussed herein (e.g., method 300). Further, the processing unit may include or be coupled to a display that may be used, for example, to provide an indication that one or more fuel injectors are in the latched condition to an operator of the vehicle and/or a maintenance system and/or a scheduling system.

The depicted processing unit includes a memory 132. The processing unit is depicted as including a single processing unit; however, the block for the processing unit may be understood as representing one or more processors that may, in some embodiments, be distributed or remote from each other.

The processing unit in various embodiments includes processing circuitry configured to perform one or more tasks, functions, or steps discussed herein (e.g., method 300 or aspects thereof). It may be noted that "processing unit" as used herein is not intended to necessarily be limited to a single processor or computer. For example, the processing unit may include multiple processors and/or computers, which may be integrated in a common housing or unit, or which may distributed among various units or housings.

Generally, various aspects (e.g., programmed modules) of the processing unit act individually or cooperatively with other aspects to perform one or more aspects of the methods, steps, or processes discussed herein (e.g., method 300, or aspects thereof). In the depicted embodiment, the memory includes a tangible, non-transitory computer readable medium having stored thereon instructions for performing one or more aspects of the methods, steps, or processes discussed herein.

Figure 3:
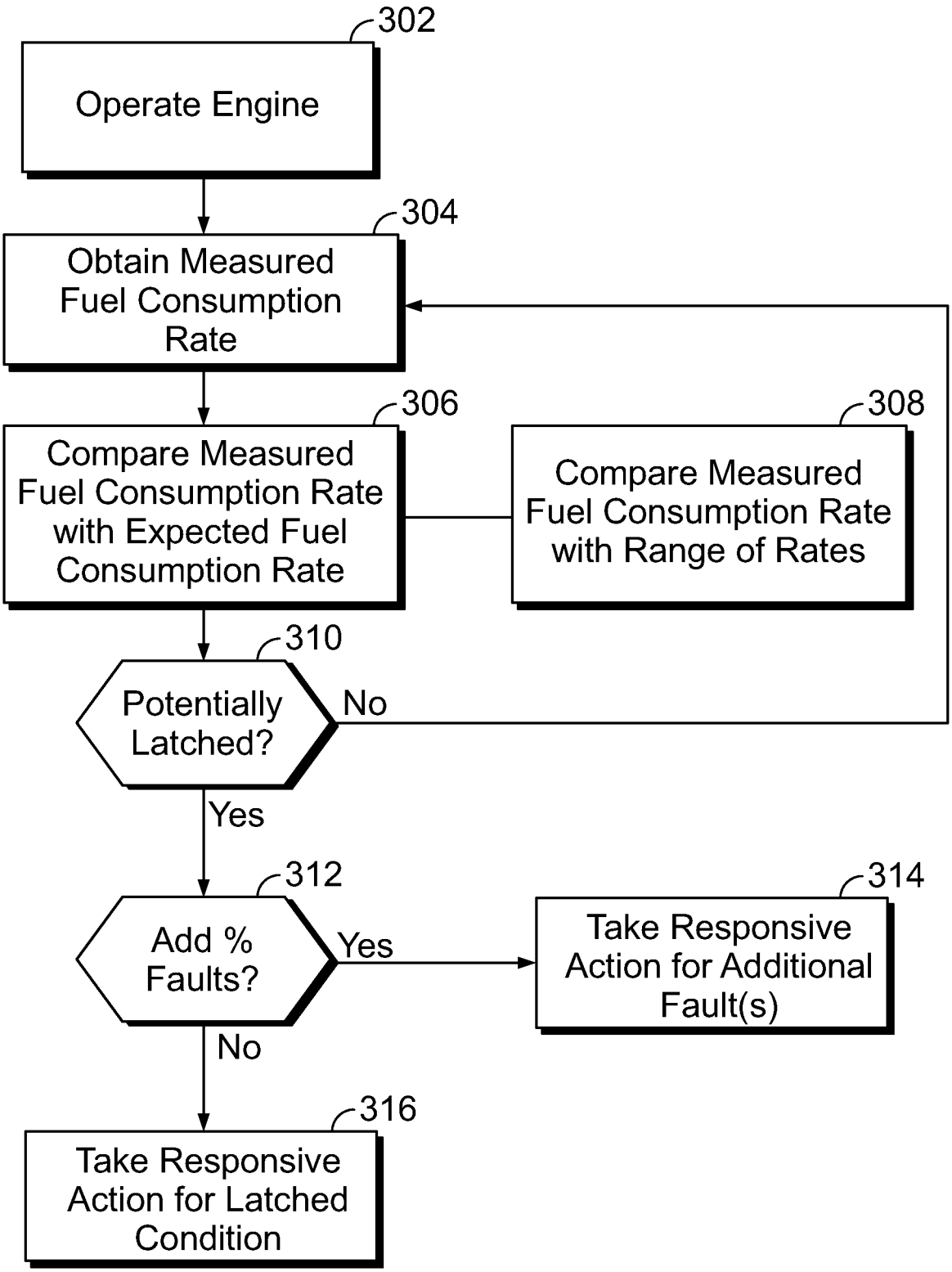
FIG. 3 illustrates a flowchart of a method.

FIG. 3 illustrates a flowchart of a method 300 (e.g., a method for internal combustion engine diagnostics including identification of a latched injector flow limiter). The operations of FIG. 3 may be implemented by one or more processors executing program instructions stored in memory. The method 300, for example, may employ structures or aspects of various embodiments (e.g., systems and/or methods) discussed herein, such as the system discussed in connection with FIG. 1. In various embodiments, certain steps (or operations) may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion. In various embodiments, portions, aspects, and/or variations of the method 300 may be used as one or more algorithms to direct hardware to perform one or more operations described herein. It should be noted, other methods may be used, in accordance with embodiments herein.

At 302, an internal combustion engine (e.g., internal combustion engine 110) is operated at a predetermined operating condition. The predetermined operating condition in various embodiments corresponds to a load or output of the engine. For example, the predetermined operating condition may correspond to a throttle notch setting.

At 304, a measured fuel consumption rate for the engine is obtained. The measured fuel consumption rate is obtained while the engine is operating at the predetermined operating condition to perform a mission. For example, the measured fuel consumption rate may be obtained at a known throttle notch while a vehicle is performing a trip. The measured fuel consumption rate may be obtained using one or more sensors associated with a fuel supply, and provided to a processing unit (e.g., ECU of a vehicle) for further use. Alternatively or additionally, the measured fuel consumption rate may be obtained using a model or other estimation performed by a processing unit (e.g., ECU of a vehicle).

At 306, the measured fuel consumption rate is compared with an expected fuel consumption rate for the predetermined operating condition. The expected fuel consumption rate may be determined using historical information and/or a neurally trained model. In the depicted example, at 308, the measured fuel consumption rate is compared with a range of rates for the expected fuel consumption rate. The range of rates, for example, is configured to account for at least one of injector wear or injector tolerance variations in various embodiments.

At 310, it is determined if the injector flow limiter is in a latched condition. The determination is made based on the measured fuel consumption rate compared with the expected fuel consumption. In various embodiments, the determination is made using a neurally trained network model that is trained to identify fuel variations to injector wear and/or to identify fuel variations due to transient operation. In the depicted example, if the measured fuel consumption rate falls within or otherwise corresponds to the expected range (or value) of fuel consumption (and/or is otherwise determined to correspond to transient operation and/or injector wear), it is determined that no injector flow limiters are in the latched condition. However, if the measured fuel consumption rate does not fall within or otherwise correspond to the expected range (or value), then it is determined that there is a potential latched condition. If no potential latched condition is identified, then the method 300 returns to 304 for ongoing monitoring of the engine. If a potential latched condition is identified, the method 300 proceeds to 312.

After a potential latched condition is identified in the illustrated example, at 312, it is determined if one or more additional faults exist. For example, it may be determined if an electrical failure and/or mechanical failure is present. If an additional fault exists, at 314, a responsive action corresponding to the additional fault may be performed. For example, a message or alert may be provided indicating the nature of the additional fault.

If no additional fault is identified, it is determined that a confirmed latching condition exists, and at 316, a responsive action is performed. The responsive action, for example, may include providing a message or alert to an operator of a vehicle and/or to a maintenance system and/or to a scheduling system. As another example, a recovery operation to unlatch an injector may be performed. Accordingly, after detection of a latched injector, the latched injector may be promptly identified and recovered, repaired, or replaced, reducing or minimizing any additional wear on the engine.

In an embodiment, a system includes one or more processors. The one or more processors are configured to obtain a measured fuel consumption rate for an internal combustion engine while the engine is operating at a predetermined operating condition to perform a mission; compare the measured fuel consumption rate with an expected fuel consumption rate for the predetermined operating condition; determine whether an injector flow limiter is in a latched condition based on the measured fuel consumption rate compared with the expected fuel consumption rate; and perform a responsive action responsive to determining that the injector flow limiter is in the latched condition.

Optionally, the one or more processors are further configured to compare the measured fuel consumption rate with a range of rates for the expected fuel consumption rate. For example, the range of rates may be configured to account for at least one of injector wear or injector tolerance variations.

Optionally, the one or more processors are configured to compare the measured fuel consumption rate with the expected fuel consumption rate and determine whether the injector flow limiter is in the latched condition using a model trained via a neural network at the predetermined operating condition. For example, the one or more processors may be configured to use the model to identify fuel variations due to injector wear and to identify fuel variations due to transient operation.

Optionally, the one or more processors are configured to determine whether the injector flow limiter is in the latched condition by determining whether one or more additional faults exist. As one example, the one or more processors may be configured to identify whether an electrical failure exists. Additionally or alternatively, the one or more processors may be configured to identify whether a mechanical failure exists.

In an embodiment, a method includes operating an internal combustion engine at a predetermined operating condition. The method also includes obtaining a measured fuel consumption rate for the engine while the engine is operating at the predetermined operating condition to perform a mission. Further, the method includes comparing the measured fuel consumption rate with an expected fuel consumption rate for the predetermined operating condition, and determining whether an injector flow limiter is in a latched condition based on the measured fuel consumption rate compared with the expected fuel consumption rate. The method further includes performing a responsive action responsive to determining that the injector flow limiter is in the latched condition.

Optionally, the measured fuel consumption rate is compared with a range of rates for the expected fuel consumption rate. For example, in some embodiments, the range of rates is configured to account for at least one of injector wear or injector tolerance variations.

Optionally, the method further includes using a model trained via a neural network at the predetermined operating condition to determine whether the injector flow limiter is in the latched condition. For example, the model may be used to identify fuel variations due to injector wear and to identify fuel variations due to transient operation.

Optionally, determining whether one or more additional faults exist is used to determine whether the injector flow limiter is in the latched condition. For example, in some embodiments, the method includes identifying at least one of whether an electrical failure exists or whether a mechanical failure exists.

Optionally, performing the responsive action comprises performing a recovery operation responsive to determining that the injector flow limiter is in the latched condition.

In an embodiment, a system includes an internal combustion engine, a fuel injector, and one or more processors. The fuel injector is coupled to and provides fuel to the engine.

The fuel injector has an injector flow limiter movable between an open state in which fuel is provided to the internal combustion engine via the fuel injector, and a latched state in which fuel is not provided to the internal combustion engine via the fuel injector. The one or more processors are coupled to the internal combustion engine, and configured to obtain a measured fuel consumption rate for the internal combustion engine while the engine is operating at a predetermined operating condition to perform a mission; compare the measured fuel consumption rate with an expected fuel consumption rate for the predetermined operating condition; determine whether an injector flow limiter is in a latched condition based on the measured fuel consumption rate compared with the expected fuel consumption rate; and perform a responsive action responsive to determining that the injector flow limiter is in the latched condition.

Optionally, the one or more processors are further configured to compare the measured fuel consumption rate with a range of rates for the expected fuel consumption rate.

Optionally, the one or more processors are configured to compare the measured fuel consumption rate with the expected fuel consumption rate and determine whether the injector flow limiter is in the latched condition using a model trained via a neural network at the predetermined engine operating condition.

Optionally, the one or more processors are configured to determine whether the injector flow limiter is in the latched condition by determining whether one or more additional faults exist.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein. Instead, the use of "configured to" as used herein denotes structural adaptations or characteristics, and denotes structural requirements of any structure, limitation, or element that is described as being "configured to" perform the task or operation. For example, a processing unit, processor, or computer that is "configured to" perform a task or operation may be understood as being particularly structured to perform the task or operation (e.g., having one or more programs or instructions stored thereon or used in conjunction therewith tailored or intended to perform the task or operation, and/or having an arrangement of processing circuitry tailored or intended to perform the task or operation). For the purposes of clarity and the avoidance of doubt, a general purpose computer (which may become "configured to" perform the task or operation if appropriately programmed) is not "configured to" perform a task or operation unless or until specifically programmed or structurally modified to perform the task or operation.

It should be noted that the particular arrangement of components (e.g., the number, types, placement, or the like) of the illustrated embodiments may be modified in various alternate embodiments. For example, in various embodiments, different numbers of a given module or unit may be employed, a different type or types of a given module or unit may be employed, a number of modules or units (or aspects thereof) may be combined, a given module or unit may be divided into plural modules (or sub-modules) or units (or sub-units), one or more aspects of one or more modules may be shared between modules, a given module or unit may be added, or a given module or unit may be omitted.

It should be noted that the various embodiments may be implemented in hardware, software or a combination thereof. The various embodiments and/or components, for example, the modules, or components and controllers therein, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as a solid state drive, optic drive, and the like. The storage device may also be other similar means for loading computer programs or other instructions into the computer or processor.

As used herein, the term "computer," "controller," "processing unit" and "module" may each include any processor-based or microprocessor-based system including systems using microcontrollers, reduced instruction set computers (RISC), application specific integrated circuits (ASICs), logic circuits, GPUs, FPGAs, and any other circuit or processor capable of executing the functions described herein. The above examples are exemplary only, and are thus not intended to limit in any way the definition and/or meaning of the term "module" or "computer."

The computer, module, or processor executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer, module, or processor as a processing machine to perform specific operations such as the methods and processes of the various embodiments described and/or illustrated herein. The set of instructions may be in the form of a software program. The software may be in various forms such as system software or application software and which may be embodied as a tangible and non-transitory computer readable medium. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program. The individual components of the various embodiments may be virtualized and hosted by a cloud type computational environment, for example to allow for dynamic allocation of computational power, without requiring the user concerning the location, configuration, and/or specific hardware of the computer system.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A system comprising:

one or more processors configured to:

obtain a measured fuel consumption rate for an internal combustion engine while the engine is operating at a predetermined operating condition to perform a mission;

compare the measured fuel consumption rate with an expected fuel consumption rate for the predetermined operating condition;

determine whether an injector flow limiter is in a latched condition based on the measured fuel consumption rate compared with the expected fuel consumption rate; and perform a responsive action responsive to determining that the injector flow limiter is in the latched condition.

2. The system of claim 1, wherein the one or more processors are further configured to compare the measured fuel consumption rate with a range of rates for the expected fuel consumption rate.

3. The system of claim 2, wherein the range of rates is configured to account for at least one of injector wear or injector tolerance variations.

4. The system of claim 1, wherein the one or more processors are configured to compare the measured fuel consumption rate with the expected fuel consumption rate and determine whether the injector flow limiter is in the latched condition using a model trained via a neural network at the predetermined operating condition.

5. The system of claim 4, wherein the one or more processors are configured to use the model to identify fuel variations due to injector wear and to identify fuel variations due to transient operation.

6. The system of claim 1, wherein the one or more processors are configured to determine whether the injector flow limiter is in the latched condition by determining whether one or more additional faults exist.

7. The system of claim 6, wherein the one or more processors are configured to identify whether an electrical failure exists.

8. The system of claim 6, wherein the one or more processors are configured to identify whether a mechanical failure exists.

9. A method including:

operating an internal combustion engine at a predetermined operating condition;

obtaining a measured fuel consumption rate for the engine while the engine is operating at the predetermined operating condition to perform a mission;

comparing the measured fuel consumption rate with an expected fuel consumption rate for the predetermined operating condition;

determining whether an injector flow limiter is in a latched condition based on the measured fuel consumption rate compared with the expected fuel consumption rate; and performing a responsive action responsive to determining that the injector flow limiter is in the latched condition.

10. The method of claim 9, wherein the measured fuel consumption rate is compared with a range of rates for the expected fuel consumption rate.

11. The method of claim 10, wherein the range of rates is configured to account for at least one of injector wear or injector tolerance variations.

12. The method of claim 9, further comprising using a model trained via a neural network at the predetermined operating condition to determine whether the injector flow limiter is in the latched condition.

13. The method of claim 12, further comprising using the model to identify fuel variations due to injector wear and to identify fuel variations due to transient operation.

14. The method of claim 9, wherein it is determined whether the injector flow limiter is in the latched condition by determining whether one or more additional faults exist.

15. The method of claim 14, further comprising identifying at least one of whether an electrical failure exists or whether a mechanical failure exists.

16. The method of claim 9, wherein performing the responsive action comprises performing a recovery operation responsive to determining that the injector flow limiter is in the latched condition.

17. A system comprising:

an internal combustion engine;

a fuel injector coupled to and providing fuel to the engine, the fuel injector having an injector flow limiter movable between an open state in which fuel is provided to the internal combustion engine via the fuel injector, and a latched state in which fuel is not provided to the internal combustion engine via the fuel injector; and one or more processors coupled to the internal combustion engine, the one or more processors configured to:

obtain a measured fuel consumption rate for the internal combustion engine while the engine is operating at a predetermined operating condition to perform a mission;

compare the measured fuel consumption rate with an expected fuel consumption rate for the predetermined operating condition;

determine whether an injector flow limiter is in a latched condition based on the measured fuel consumption rate compared with the expected fuel consumption rate; and perform a responsive action responsive to determining that the injector flow limiter is in the latched condition.

18. The system of claim 17, wherein the one or more processors are further configured to compare the measured fuel consumption rate with a range of rates for the expected fuel consumption rate.

19. The system of claim 17, wherein the one or more processors are configured to compare the measured fuel consumption rate with the expected fuel consumption rate and determine whether the injector flow limiter is in the latched condition using a model trained via a neural network at the predetermined engine operating condition.

20. The system of claim 17, wherein the one or more processors are configured to determine whether the injector flow limiter is in the latched condition by determining whether one or more additional faults exist.

* * * * *